US010118403B2

(12) United States Patent
Maeda et al.

(10) Patent No.: US 10,118,403 B2
(45) Date of Patent: Nov. 6, 2018

(54) DROPLET EJECTING APPARATUS, IMAGE FORMING APPARATUS, AND NON-TRANSITORY COMPUTER READABLE MEDIUM STORING PROGRAM

(71) Applicant: FUJI XEROX CO., LTD., Tokyo (JP)

(72) Inventors: Kotaro Maeda, Kanagawa (JP); Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/729,698

(22) Filed: Oct. 11, 2017

(65) Prior Publication Data

US 2018/0104962 A1 Apr. 19, 2018

(30) Foreign Application Priority Data

Oct. 19, 2016 (JP) ..... 2016-204994

(51) Int. Cl.

*B41J 2/21* (2006.01)
*B41J 2/045* (2006.01)
*B41J 2/14* (2006.01)

(52) U.S. Cl.

CPC ..... *B41J 2/2139* (2013.01); *B41J 2/0451* (2013.01); *B41J 2/04526* (2013.01); *B41J 2/04581* (2013.01); *B41J 2/04588* (2013.01); *B41J 2/14233* (2013.01); *B41J 2/2146* (2013.01)

(58) Field of Classification Search

CPC .... B41J 2/2139; B41J 2/2146; B41J 2/14233; B41J 2/04588; B41J 2/04526; B41J 2/0451; B41J 2/04581

See application file for complete search history.

(56) References Cited

U.S. PATENT DOCUMENTS

2006/0256157 A1* 11/2006 Kim ..... B41J 2/2139 347/47
2011/0134174 A1 6/2011 Seto
2011/0279500 A1 11/2011 Mitsuki

FOREIGN PATENT DOCUMENTS

JP 2011-121211 6/2011
JP 2011-235576 11/2011
JP 200574956 A * 7/2018 ..... B41J 2/01

OTHER PUBLICATIONS

Concise Statement of JP 2011-121211 and JP 2011-235576.

* cited by examiner

*Primary Examiner* — Julian Huffman
(74) *Attorney, Agent, or Firm* — Fildes & Outland, P.C.

(57) ABSTRACT

A droplet ejecting apparatus includes: an ejecting section having a plurality of nozzles arranged along an intersecting direction with a transport direction of a recording medium. Each nozzle ejects a main droplet and a sub-droplet smaller than the main droplet consecutively. Each nozzle can change a deflection amount in an ejecting direction of the main droplet along the intersecting direction. A control section performs, in a case where a defective nozzle exists in the nozzles, a control of deflecting the ejecting directions of the main droplets ejected from a nozzle positioned within a predetermined distance from the defective nozzle toward a landing position of a main droplet that should have ejected from the defective nozzle.

7 Claims, 12 Drawing Sheets

AT HIGH VOLTAGE

AT LOW VOLTAGE

DROPLET EJECTING APPARATUS, IMAGE FORMING APPARATUS, AND NON-TRANSITORY COMPUTER READABLE MEDIUM STORING PROGRAM

CROSS-REFERENCE TO RELATED APPLICATIONS

This application is based on and claims priority under 35 USC 119 from Japanese Patent Application No. 2016-204994 filed on Oct. 19, 2016.

BACKGROUND

Technical Field

The present invention relates to a droplet ejecting apparatus, an image forming apparatus, and a non-transitory computer readable medium storing a program.

SUMMARY

According to an aspect of the invention, there is provided a droplet ejecting apparatus including:

an ejecting section having a plurality of nozzles arranged along an intersecting direction with a transport direction of a recording medium, each of the nozzles being configured to consecutively eject a main droplet and a sub-droplet which is smaller than the main droplet, and each of the nozzles being configured to change a deflection amount in an ejecting direction of the main droplet along the intersecting direction; and a control section that performs, in a case where a defective nozzle exists in the nozzles, a control of deflecting the ejecting directions of the main droplets ejected from a nozzle positioned within a predetermined distance from the defective nozzle toward a landing position of a main droplet that should have ejected from the defective nozzle, and that perform a control of the nozzle positioned within the predetermined distance to consecutively eject the main droplet and the sub-droplet.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment for carrying out the invention will be described with reference to the drawings.

Figure 1:
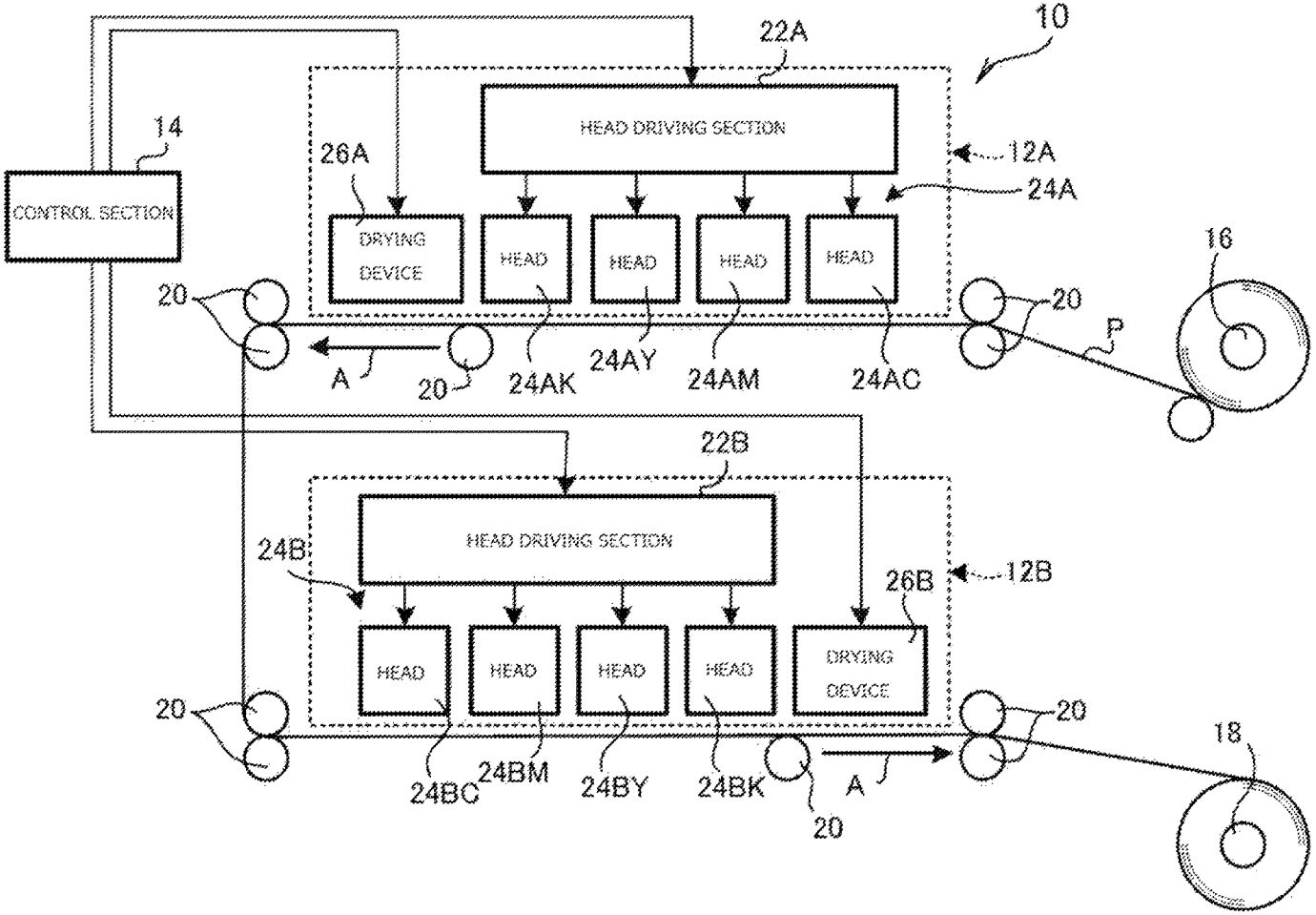
FIG. 1 is a configuration view illustrating a main configuration of a droplet ejection type recording device according to an exemplary embodiment.

First, a configuration of a droplet ejection type recording device 10 which is an example of an image forming apparatus according to the exemplary embodiment will be described with reference to FIG. 1. Hereinafter, the cyan color is expressed by C, the magenta color is expressed by M, the yellow color is expressed by Y, and the black color is expressed by K, and in a case where it is necessary to distinguish each of the configuration components and toner images for each color, marks (C, M, Y, and K) of colors that correspond to each of the colors are attached to the end of the marks in the description. Hereinafter, in a case of generally calling each of the configuration components and the toner images without distinguishing each color, the marks of the colors at the end of the marks will be omitted in the description.

The droplet ejection type recording device 10 includes, for example, two groups of image forming sections 12A and 12B which form an image on both surfaces of a paper sheet P by one time of transport, a control section 14, a paper feeding roll 16, an exit roll 18, and plural transport rollers 20.

The image forming section 12A includes a head driving section 22A, a head 24A, and a drying device 26A. Similarly, the image forming section 12B includes a head driving section 22B, a head 24B, and a drying device 26B. Hereinafter, in a case where the image forming section 12A and the image forming section 12B and a common member included both in the image forming section 12A and in the image forming section 12B are not necessarily distinguished from each other, there is a case where the mark "A" and the mark "B" at the end of the mark is omitted.

By driving a transporting motor 62 (refer to FIG. 11) the control section 14 controls, for example, the rotation of the transport roller 20 connected to the transporting motor 62 via a mechanism, such as a gear. In the paper feeding roll 16, the long paper sheet P is wound as an example of a recording medium, and the paper sheet P is transported in a direction of an arrow A of FIG. 1 in accordance with the rotation of the transport roller 20. Hereinafter, the transport direction (the direction of the arrow A of FIG. 1) of the paper sheet P is simply referred to as "transport direction".

The control section 14 forms the image which corresponds to the image information on one image forming surface of the paper sheet P by receiving the image information and by controlling the image forming section 12A based on color information of each pixel of the image included in the image information.

Specifically, the control section 14 controls the head driving section 22A by instructing an ejection timing of a droplet to the head driving section 22A. In accordance with the ejection timing of the droplet instructed from the control section 14, the head driving section 22A drives the head 24A connected thereto, ejects the droplet from the head 24A, and forms the image that corresponds to the image information on one image forming surface of the paper sheet P transported in accordance with the control of the control section 14.

The color information of each pixel of the image included in the image information includes information that uniquely indicates the color of the pixel. In the exemplary embodiment, as an example, the color information of each pixel of the image is expressed by density of each of C, M, Y, and K, but other expression methods for uniquely indicating the color of the pixel may be used.

The head 24A includes four heads 24AC, 24AM, 24AY, and 24AK which correspond to each of the four colors, such as C, M, Y, and K, and ejects the droplet of the color that corresponds to each of the heads 24A. A head driving section 22 and a head 24 are an example of an ejecting section of the invention.

The control section 14 dries the image formed on the paper sheet P by the drying device 26A, and fixes the image to the paper sheet P.

After this, the paper sheet P is transported to a position that corresponds to the image forming section 12B in accordance with the rotation of the transport roller 20. At this time, the paper sheet P is transported while the front and rear surfaces thereof are reversed to each other such that the other image forming surface different from the image forming surface on which the image is formed by the image forming section 12A faces the image forming section 12B.

The control section 14 forms the image that corresponds to the image information on the other image forming surface of the paper sheet P by executing a control similar to a control with respect to the above-described image forming section 12A with respect to the image forming section 12B.

The head 24B includes four heads 24BC, 24BM, 24BY, and 24BK which correspond to each of the four colors of C, M, Y, and K, and ejects the droplet of the corresponding color from each of the heads 24B.

The control section 14 dries the image formed on the paper sheet P by the drying device 26B, and fixes the image to the paper sheet P.

After this, the paper sheet P is transported to a position of the exit roll 18 in accordance with the rotation of the transport roller 20, and is wound around the exit roll 18.

In the droplet ejection type recording device 10 according to the exemplary embodiment, an apparatus configuration which forms the image on both surfaces of the paper sheet P by one time of transport from the paper feeding roll 16 to the exit roll 18, is described, but an apparatus configuration which forms the image on one side surface of the paper sheet P may be employed.

In the droplet ejection type recording device 10 according to the exemplary embodiment, water-based ink is applied as the droplet, but the invention is not limited thereto, and as the droplet, for example, oil-based ink which is ink of which solvent is evaporated, ultraviolet curing type ink or the like, may be employed.

Figure 2:
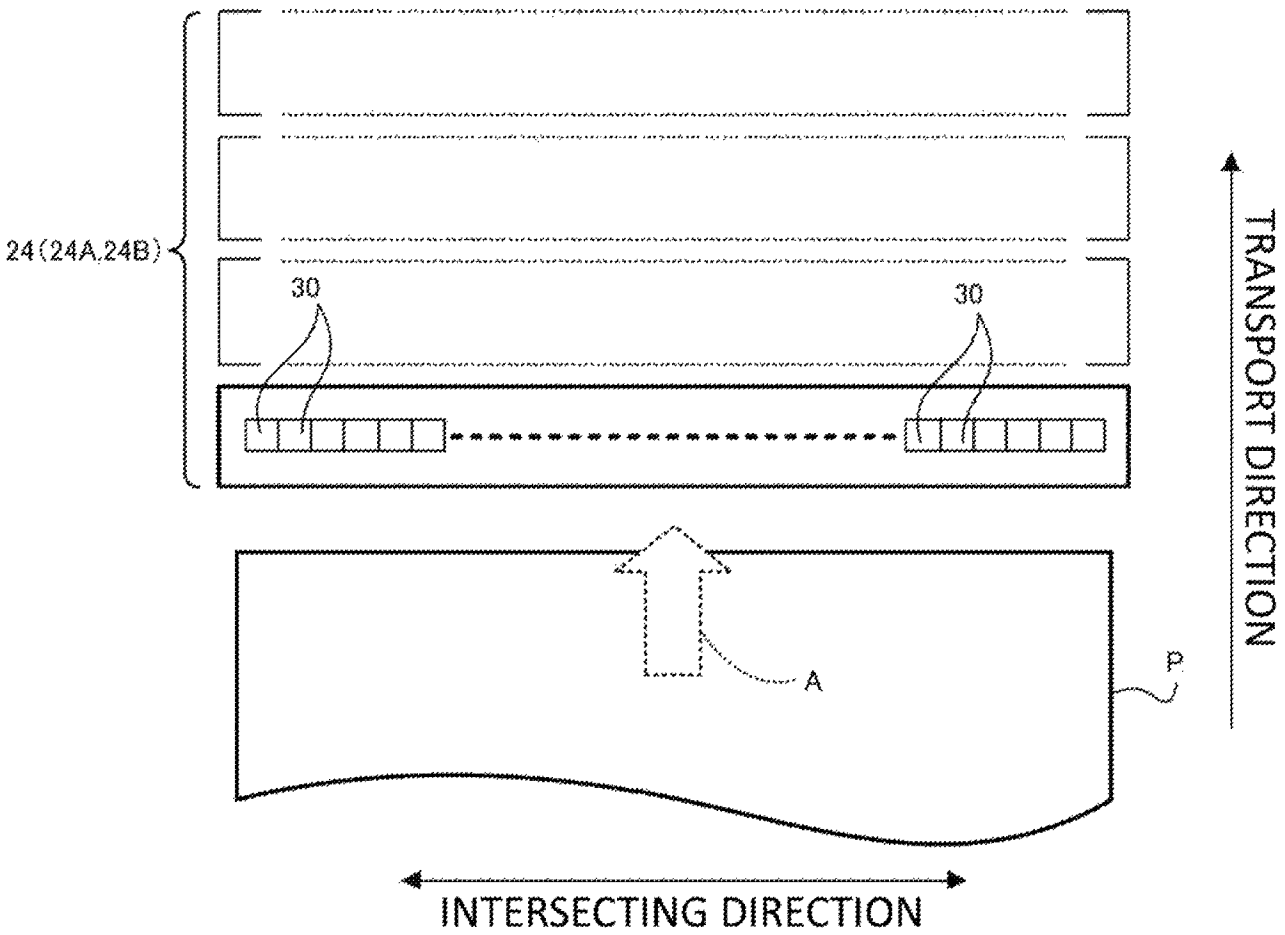
FIG. 2 is a plan view illustrating a configuration of a head according to the exemplary embodiment.

Next, a configuration of the head 24 according to the exemplary embodiment will be described with reference to FIG. 2. As illustrated in FIG. 2, in the head 24, plural droplet ejecting members 30 are linearly disposed along a longitudinal direction of the head 24. The longitudinal direction of the head 24 is an intersecting direction which intersects (orthogonal in the exemplary embodiment) with the transport direction (the direction of the arrow A of FIG. 2) (hereinafter, simply referred to as "intersecting direction").

A droplet ejecting member 30 is not limited to a member which is linearly disposed along the intersecting direction, and for example, may be disposed in a zigzag shape along the intersecting direction.

Figure 3:
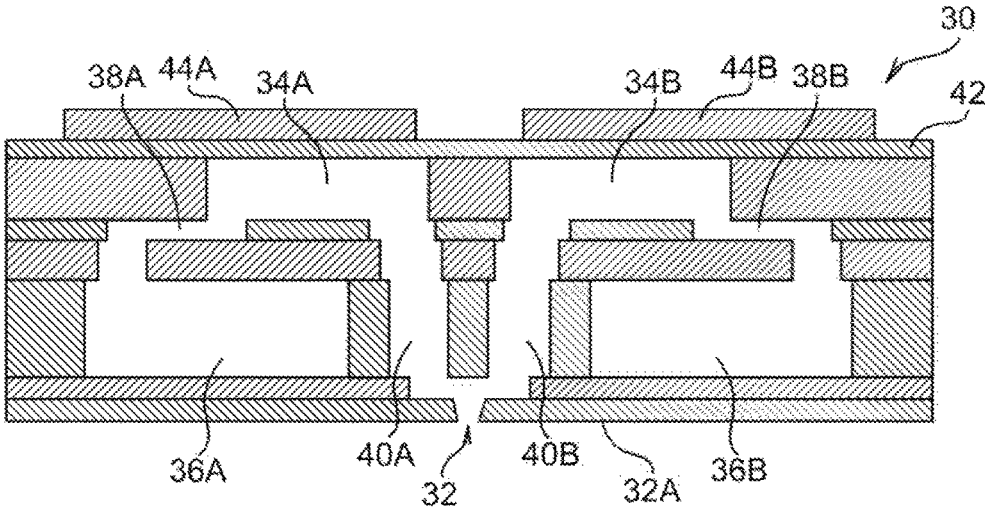
FIG. 3 is a sectional view illustrating an internal structure of a droplet ejecting member according to the exemplary embodiment.

Next, a configuration of the droplet ejecting member 30 according to the exemplary embodiment will be described with reference to FIG. 3. As illustrated in FIG. 3, the droplet ejecting member 30 includes one nozzle 32 and two pressure chambers 34A and 34B.

The droplet ejecting member 30 includes common flow paths 36A and 36B corresponding to each of the pressure chambers 34A and 34B. The common flow paths 36A and 36B supply an ink droplet via flow paths 38A and 38B to the pressure chambers 34A and 34B of the droplet ejecting member 30 from an ink supply tank (not illustrated) which is a supply source of the ink droplet. The pressure chambers 34A and 34B are linked to the nozzle 32 via flow paths 40A and 40B.

A diaphragm 42 is attached to an upper surface of a ceiling section of the pressure chambers 34A and 34B. Corresponding to each of the pressure chambers 34A and 34B, on the upper surface of the diaphragm 42, piezoelectric elements 44A and 44B are laminated. A voltage (hereinafter, referred to as "ejection voltage") is applied to the piezoelectric element 44A in accordance with a signal (hereinafter, referred to as "ejection signal") of an ejection waveform which will be described later. A voltage (hereinafter, referred to as "deflection voltage") is applied to the piezoelectric elements 44B in accordance with a signal (hereinafter, referred to as "deflection signal") of a deflection waveform which will be described later.

When the ejection voltage is applied to the piezoelectric element 44A and the deflection voltage is applied to the piezoelectric elements 44B, the piezoelectric elements 44A and 44B displace the diaphragm 42 such that a volume of each of the corresponding pressure chambers 34A and 34B is changed, and generates a pressure with respect to the ink droplet that fills the inside of the pressure chambers 34A and 34B. Accordingly, the ink droplet is supplied to the nozzle 32 via the flow paths 40A and 40B from the pressure chambers 34A and 34B, and the droplet is ejected from the nozzle 32.

The control section 14 controls the head driving section 22 based on the image information, and generates the ejection signal for applying the ejection voltage to the piezoelectric element 44A. The control section 14 controls the head driving section 22 based on the image information, and generates the deflection signal for applying the deflection voltage to the piezoelectric elements 44B.

Figure 4:
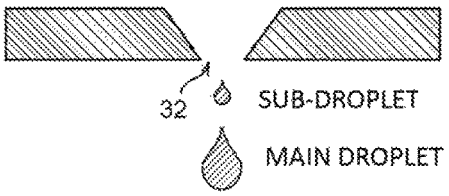
FIG. 4 is a sectional view for describing a main droplet and a sub-droplet according to the exemplary embodiment.

Meanwhile, as illustrated in FIG. 4 as an example, in a case of ejecting the droplet from the nozzle 32, the droplet ejecting member 30 according to the exemplary embodiment can consecutively eject a main droplet which is a major droplet and a sub-droplet (so-called a satellite droplet) which is a droplet having a size smaller than that of the main droplet by one time of ejection operation.

Figure 5A:
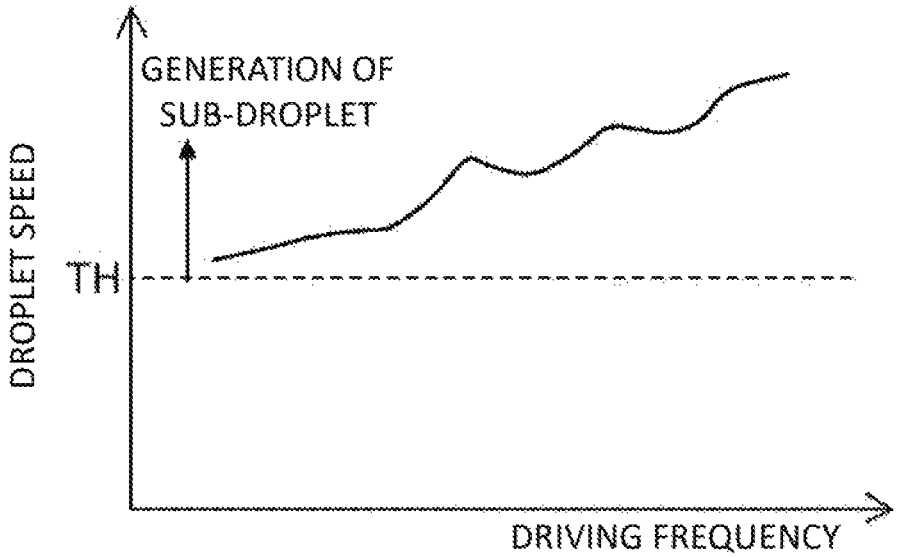
FIGS. 5A and 5B are graphs illustrating an example of a relationship between a droplet speed of a droplet and a driving frequency of a nozzle according to the exemplary embodiment.
Figure 5B:
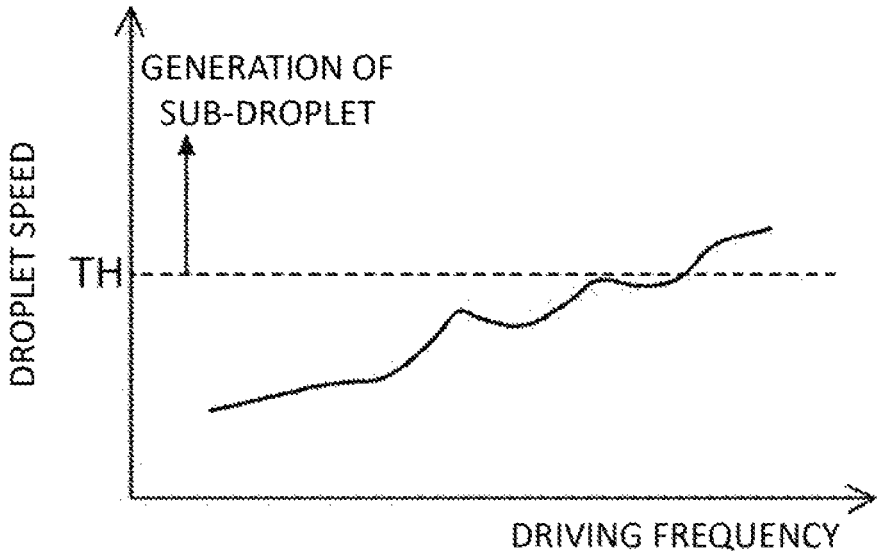

Next, controls in a case of ejecting only the main droplet of the main droplet and the sub-droplet from the nozzle 32 and in a case of consecutively ejecting the main droplet and the sub-droplet from the nozzle 32, will be described with reference to FIGS. 5A and 5B. FIG. 5A illustrates an example of a relationship between a droplet speed of the droplet in a case where the ejection voltage having a relatively high voltage value (for example, 29 [V]) is applied to the piezoelectric element 44A and a driving frequency of the nozzle 32. FIG. 5B illustrates an example of a relationship between a droplet speed of the droplet in a case where an ejection voltage having a relatively low voltage value (for example, 21 [V]) is applied to the piezoelectric element 44A and a driving frequency of the nozzle 32. A threshold value TH illustrated in FIGS. 5A and 5B is a threshold value which indicates generation of the sub-droplet in a case where the droplet speed of the droplet is equal to or higher than the value.

The driving frequency of the nozzle 32 referred here is a value determined in accordance with the ejection interval of the droplet by the nozzle 32, and is a value that changes in accordance with the image information that indicates the image which is a forming target and the transport speed of the paper sheet P. For example, in a case where the image which is the forming target is a solid image, the driving frequency of the nozzle 32 becomes a relatively high frequency. For example, in a case where the image which is the forming target is the image in which a line along the intersecting direction is disposed with a void along the transport direction, characters and the like, the driving frequency of the nozzle 32 becomes a relatively low frequency. In the exemplary embodiment, the transport speed of the paper sheet P is set in advance by a user or the like. The droplet speed referred here is expressed by a movement amount of the droplet in the ejecting direction per unit time.

As illustrated in FIGS. 5A and 5B, as the ejection voltage increases, the droplet speed increases, and the sub-droplet is likely to be generated. As the driving frequency of the nozzle 32 increases, the droplet speed increases, and the sub-droplet is likely to be generated.

Here, the control section 14 according to the exemplary embodiment derives the driving frequency of the nozzle 32 based on the image information which indicates the image which is the forming target and the transport speed of the paper sheet P. In a case where only the main droplet of the main droplet and the sub-droplet is ejected from the nozzle 32, at the derived driving frequency, the control section 14 applies the ejection voltage in which the droplet speed is lower than the threshold value TH to the piezoelectric element 44A.

Meanwhile, in a case where the main droplet and the sub-droplet are consecutively ejected from the nozzle 32, at the derived driving frequency, the control section 14 applies the ejection voltage in which the droplet speed is equal to or higher than the threshold value TH to the piezoelectric element 44A.

Figure 6:
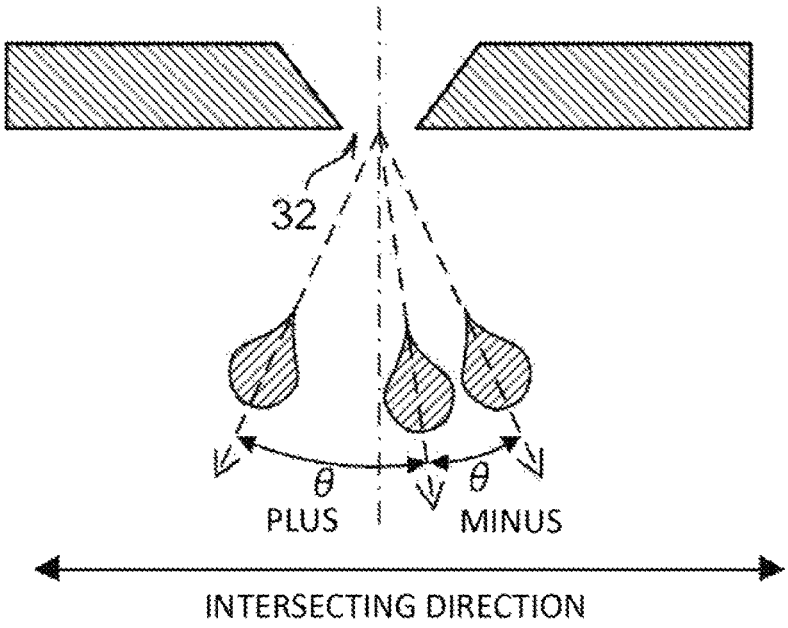
FIG. 6 is a sectional view for describing an ejection angle of the droplet according to the exemplary embodiment.

As illustrated in FIG. 6 as an example, the droplet ejecting member 30 according to the exemplary embodiment can eject the droplet by deflecting the ejecting direction of the droplet of the nozzle 32 by changing the deflection amount along the intersecting direction. Hereinafter, in a case of simply referring to the deflection, the deflection means deflection along the intersecting direction.

In a case of ejecting the droplet from the nozzle 32 without deflection, the control section 14 does not apply the deflection voltage to the piezoelectric elements 44B, and applies the ejection voltage to the piezoelectric element 44A. Meanwhile, in a case of ejecting the droplet from the nozzle 32 with deflection, the control section 14 applies the deflection voltage to the piezoelectric elements 44B, and applies the ejection voltage to the piezoelectric element 44A.

Hereinafter, as illustrated in FIG. 6, an ejection angle θ in the ejecting direction of the droplet in a case where the droplet is deflected to the piezoelectric element 44A side (left side in the example of FIG. 6) regarding the ejecting direction of the droplet in a case of ejecting the droplet from the nozzle 32 without the deflection as a reference, is a plus angle. An ejection angle θ in the ejecting direction of the droplet in a case where the droplet is deflected to the piezoelectric elements 44B side (right side in the example of FIG. 6) regarding the ejecting direction of the droplet in a case of ejecting the droplet from the nozzle 32 without the deflection as a reference, is a minus angle.

A control of ejecting the droplet from the nozzle 32 by deflecting the droplet along the intersecting direction will be described with reference to FIGS. 7 to 10.

Figure 7:
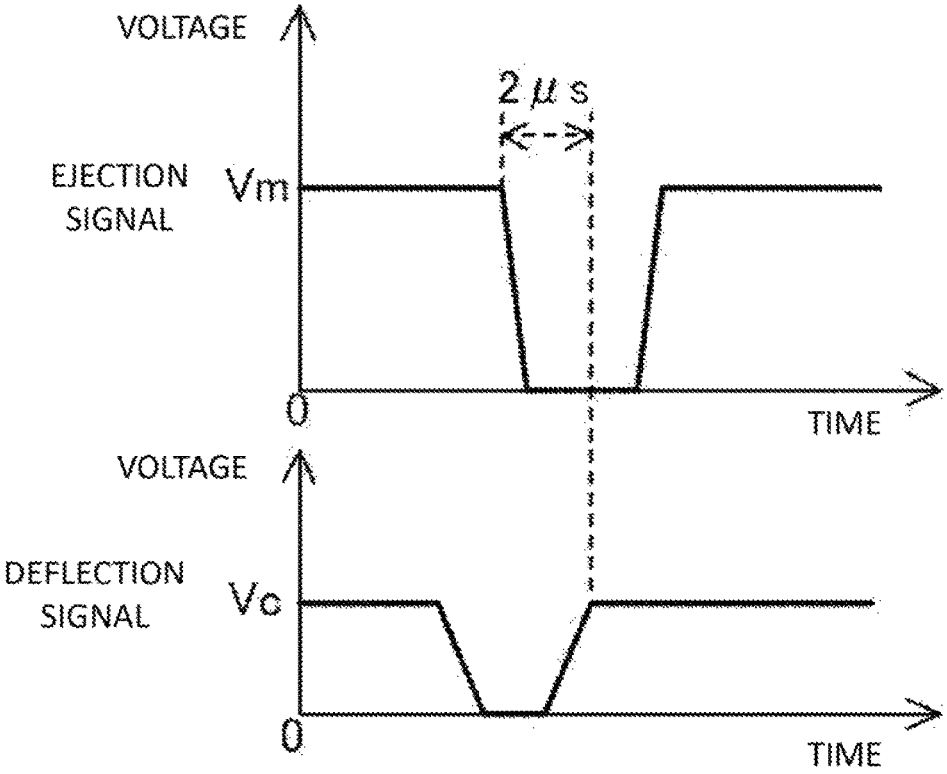
FIG. 7 is a waveform chart illustrating an example of a waveform of an ejection signal and a deflection signal in a case where the droplet is deflected by the minus ejection angle according to the exemplary embodiment.

In a case of deflecting the droplet by the ejection angle θ which is the minus angle, the control section 14 applies an ejection voltage Vm to the piezoelectric element 44A in accordance with the ejection signal of the ejection waveform that is illustrated at an upper part of FIG. 7 as an example. n the exemplary embodiment, as the ejection voltage Vm, a voltage within a range determined in advance as a range in which the ejection of the droplet is possible (in the exemplary embodiment, a voltage from 21 [V] to 29 [V]) is employed in accordance with design specification or the like of the droplet ejecting member 30.

Figure 8:
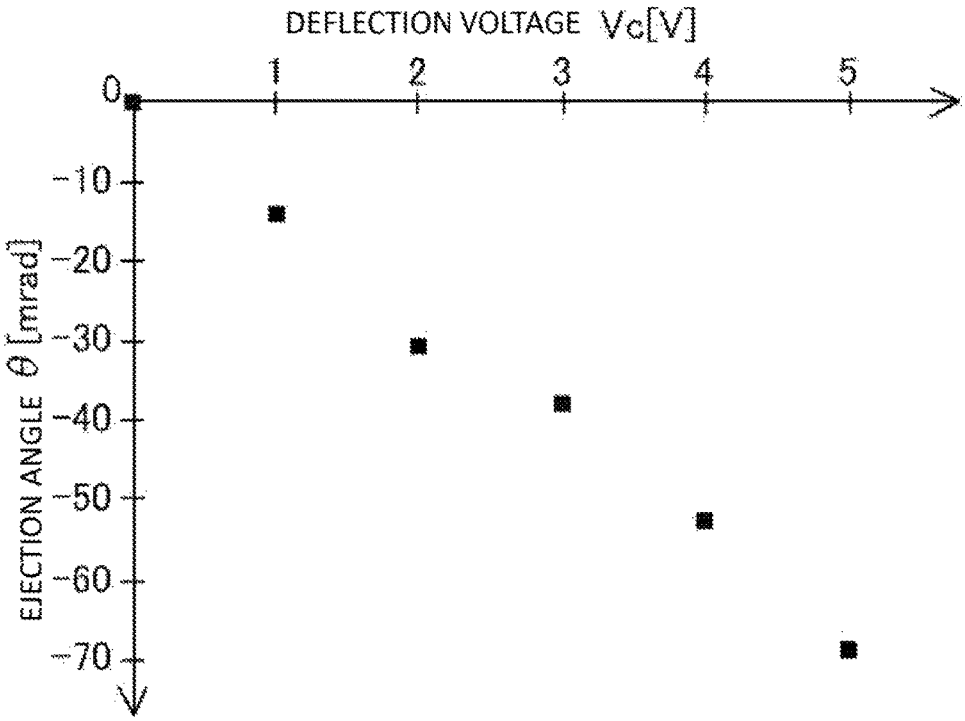
FIG. 8 is a graph illustrating an example of a relationship between a deflection voltage and an ejection angle according to the exemplary embodiment.

In a case of deflecting the droplet by the ejection angle θ which is the minus angle, the control section 14 applies a deflection voltage Vc to the piezoelectric elements 44B in accordance with the deflection signal of the deflection waveform that is illustrated at a lower part of FIG. 7 as an example. As illustrated in FIG. 8 as an example, the control section 14 ejects the droplet from the nozzle 32 by changing the ejection angle θ, by changing the voltage value of the deflection voltage Vc.

Figure 9:
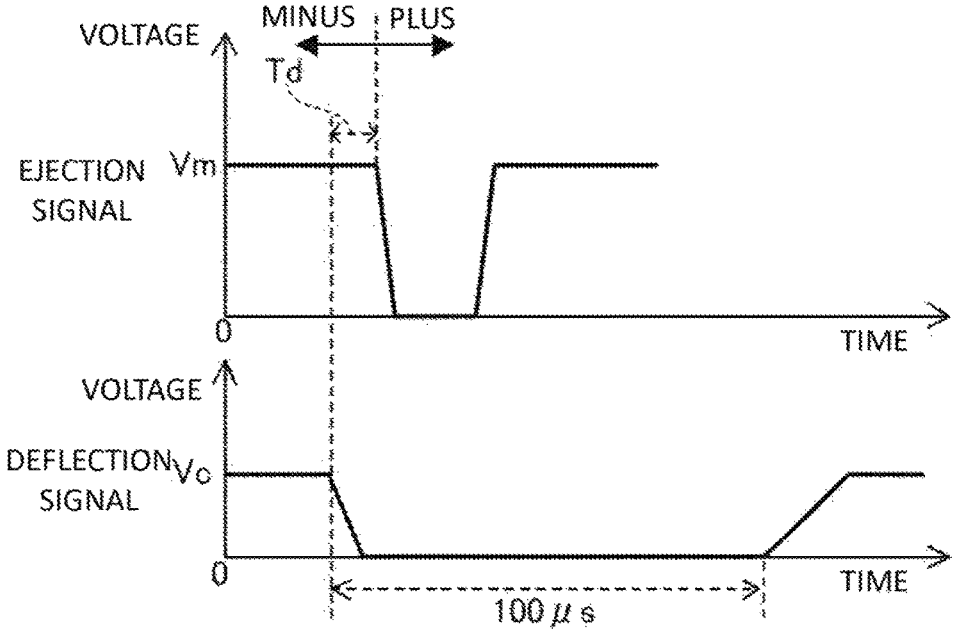
FIG. 9 is a waveform view illustrating an example of a waveform of the ejection signal and the deflection signal in a case where the droplet is deflected by a plus ejection angle according to the exemplary embodiment.
Figure 10:
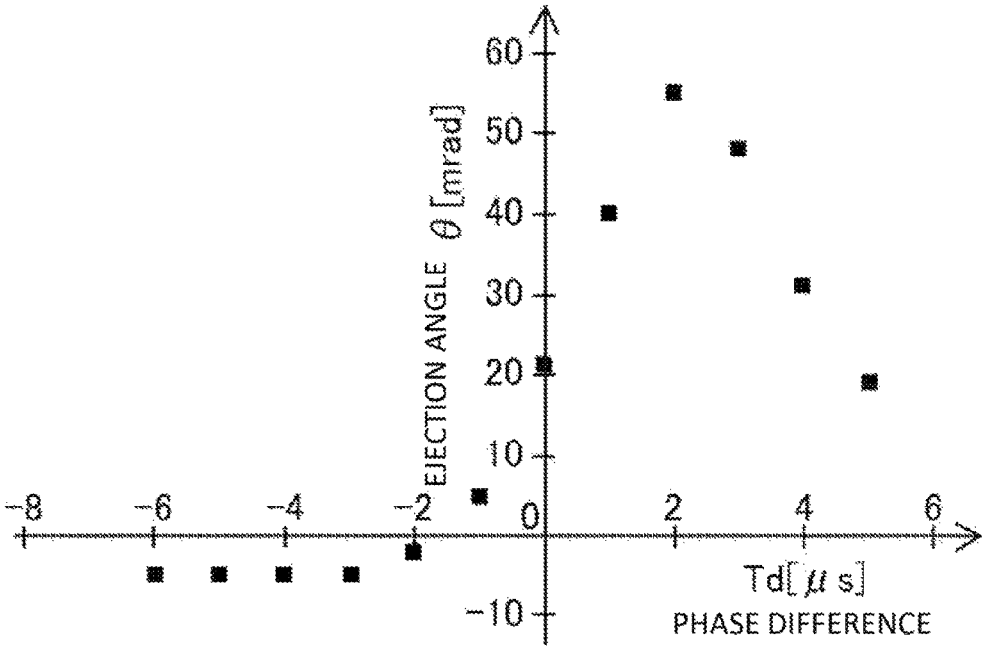
FIG. 10 is a graph illustrating an example of a relationship between a phase difference and the ejection angle according to the exemplary embodiment.

Meanwhile, in a case of deflecting the droplet by the ejection angle θ which is the plus angle, the control section 14 applies the ejection voltage Vm to the piezoelectric element 44A in accordance with the ejection signal (a signal which is similar to the ejection signal illustrated at an upper part of FIG. 7) that is illustrated at an upper part of FIG. 9 as an example. In a case of deflecting the droplet by the ejection angle θ which is the plus angle, the control section 14 applies the deflection voltage Vc (for example, voltage of 5 [V]) to the piezoelectric elements 44B in accordance with the deflection signal that is illustrated at a lower part of FIG. 9 as an example. As illustrated in FIG. 10 as an example, by changing a phase difference Td between the ejection signal and the deflection signal, the control section 14 ejects the droplet from the nozzle 32 by changing the ejection angle θ. Hereinafter, the deflection signal that is illustrated at a lower part of FIG. 7 is referred to as "first deflection signal", and the deflection signal that is illustrated at a lower part of FIG. 9 is referred to as "second deflection signal".

The detailed contents of the control for ejecting the droplet from the nozzle 32 by deflecting the droplet along the intersecting direction, JP-A-2011-121211 is disclosed, and thus, more detailed description will be omitted here.

Next, a main configuration of an electric system of the droplet ejection type recording device 10 according to the exemplary embodiment will be described with reference to FIG. 11.

Figure 11:
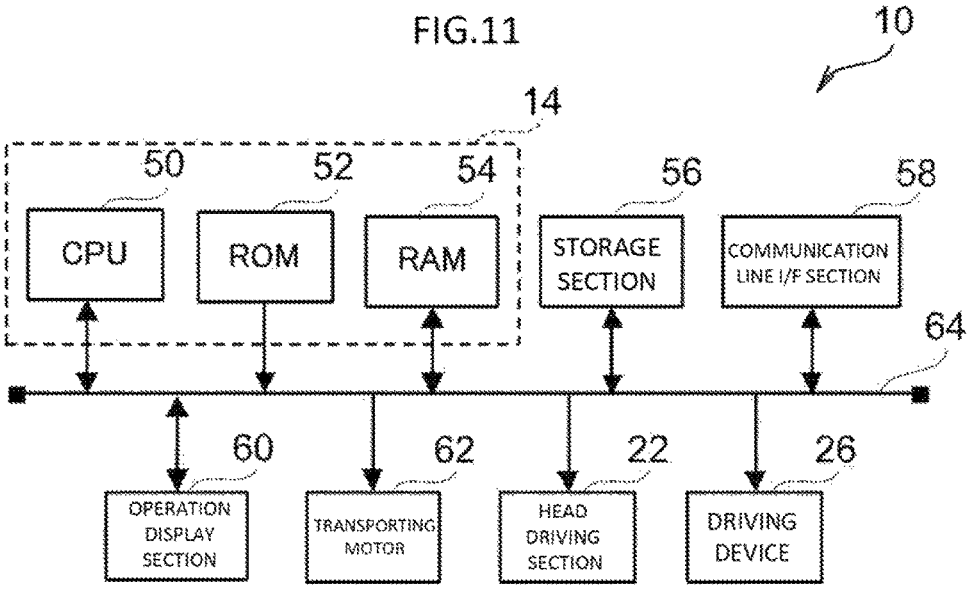
FIG. 11 is a block diagram illustrating a main configuration of an electric system of the droplet ejection type recording device according to the exemplary embodiment.

As illustrated in FIG. 11, the control section 14 according to the exemplary embodiment includes a central processing unit (CPU) 50 which manages the entire operation of the droplet ejection type recording device 10, and a read only memory (ROM) 52 in which various programs, various parameters and the like are stored in advance. The control section 14 includes a random access memory (RAM) 54 which is used as a work area or the like while executing various programs by the CPU 50.

The droplet ejection type recording device 10 includes a volatile storage section 56, such as a flash memory, and a communication line interface (I/F) section 58 which sends and receives communication data to and from an external apparatus. The droplet ejection type recording device 10 includes an operation display section 60 which displays various types of information related to an operation situation or the like of the droplet ejection type recording device 10 with respect to the user while receiving an instruction from the user with respect to the droplet ejection type recording device 10. The operation display section 60 includes a display on which a touch panel is provided on a display surface that displays a display button for receiving the operation instruction by executing the program or various types of information, and a hardware key, such as a numeric key or a start button.

Each section of the CPU 50, the ROM 52, the RAM 54, the storage section 56, the communication line I/F section 58, the operation display section 60, the transporting motor 62, the head driving section 22, and the second direction 26 is connected to each other via a bus 64, such as an address bus, a data bus, and a control bus.

By the above-described configuration, by the CPU 50, the droplet ejection type recording device 10 according to the exemplary embodiment gets access to the ROM 52, the RAM 54, and the storage section 56, and sends and receives the communication data to and from the external apparatus via the communication line I/F section 58, respectively. By the CPU 50, the droplet ejection type recording device 10 obtains various types of instruction information via the operation display section 60, and displays various types of information with respect to the operation display section 60, respectively. By the CPU 50, the droplet ejection type recording device 10 performs a control of the transporting motor 62, a control of the head driving section 22, and a control of the second direction 26, respectively.

However, in the head 24 according to the exemplary embodiment, there is a case where a defective nozzle exists in the plural nozzles 32 of the droplet ejecting members 30 provided in the head 24. In this case, in a case of ejecting the droplet from each of the nozzles 32 without the deflection, a dot at a part which corresponds to a defective nozzle is lost, a stripe or the like along the transport direction is generated in the image formed on the paper sheet P, and the image quality deteriorates.

Figure 12:
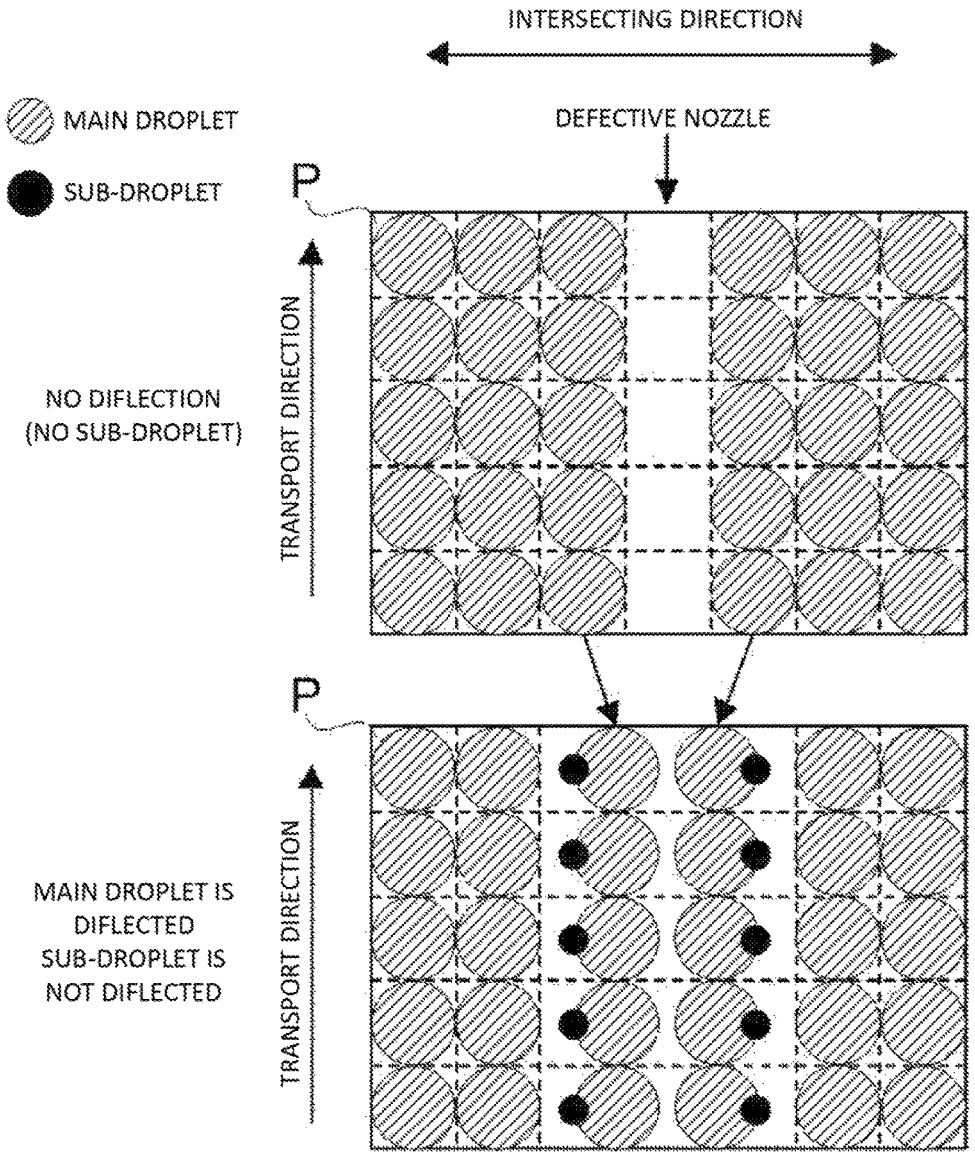
FIG. 12 is a plan view illustrating an example of the main droplet and the sub-droplet which land on a paper sheet in a case where the main droplet is not deflected and in a case where the main droplet is deflected according to the exemplary embodiment.

Here, the droplet ejection type recording device 10 according to the exemplary embodiment ejects the main droplet and the sub-droplet of the main droplet and the sub-droplet which are ejected from the nozzle 32 positioned within the distance determined in advance from the defective nozzle, by deflecting the ejecting direction of the main droplet toward a position which corresponds to a landing position of the main droplet of the defective nozzle along the intersecting direction. Specifically, as illustrated in FIG. 12 as an example, the droplet ejection type recording device 10 ejects the main droplet and the sub-droplet by deflecting the ejecting direction of the main droplet of each one of the nozzles 32 adjacent to both sides of the defective nozzle toward the landing position of the main droplet of the defective nozzle along the intersecting direction. Hereinafter, the nozzle 32 which deflects and ejects the main droplet is referred to as "deflection nozzle 32". The position which corresponds to the landing position of the main droplet of the defective nozzle means the landing position in a case where the main droplet is ejected without deflection in a case where the defective nozzle can normally eject the main droplet.

In this case, the droplet ejection type recording device 10 ejects the main droplet of the deflection nozzle 32 at the position between the landing position of the main droplet of the defective nozzle in a case where the main droplet is not deflected and the landing position of the main droplet of the deflection nozzle 32. In the exemplary embodiment, as an example, the droplet ejection type recording device 10 ejects the main droplet by deflecting the ejecting direction of the main droplet of the deflection nozzle 32 to a direction of being shifted to the defective nozzle side along the intersecting direction by ⅓ of a diameter of one dot, regarding a case where the main droplet is not deflected as a reference.

The droplet ejection type recording device 10 according to the exemplary embodiment ejects the sub-droplet from the deflection nozzle 32 positioned within a distance determined in advance from the defective nozzle without deflection. Furthermore, the droplet ejection type recording device 10 according to the exemplary embodiment ejects the main droplet without deflection, with respect to the nozzle 32 positioned out of the range of the distance determined in advance from the defective nozzle.

In a case where the main droplet of the deflection nozzle 32 is not deflected, the maximum void length between the dots is a diameter of one dot which corresponds to the defective nozzle. Meanwhile, in the droplet ejection type recording device 10 according to the exemplary embodiment, the maximum void length between the dots becomes ⅓ of the diameter of one dot, the sub-droplet lands on the void generated due to the deflection of the main droplet, and as a result, the stripe generated due to the defective nozzle does not stand out, and deterioration of image quality is suppressed.

In the exemplary embodiment, the defective nozzle is detected when manufacturing the head 24, and nozzle identification information which identifies the defective nozzle is stored in the storage section 56 in advance. The nozzle identification information is not particularly limited as long as the information is information that can specify the defective nozzle. For example, an aspect in which continuous numbers are given to each of the nozzles 32 regarding one end section of the head 24 as a reference, and the number of the defective nozzle is employed as the nozzle identification information, is illustrated as an example. For example, an aspect in which the distance to the defective nozzle regarding one end section of the head 24 as a reference is employed as the nozzle identification information, is illustrated as an example.

After the droplet ejection type recording device 10 is shipped and is started to be used by the user, a test chart for detecting the defective nozzle may be formed on the paper sheet P, the defective nozzle may be detected from the image formed on the paper sheet P, and the nozzle identification information may be stored in the storage section 56.

In the exemplary embodiment, frequency information which indicates a correspondence relationship (refer to FIGS. 5A and 5B) between the driving frequency and the droplet speed of the deflection nozzle 32 is stored in advance in the storage section 56 for each different voltage value.

In the exemplary embodiment, first deflection information which indicates a correspondence relationship (refer to FIG. 8) between the ejection angle θ that corresponds to the deflection amount of the droplet and the deflection voltage Vc, is stored in advance in the storage section 56. In the exemplary embodiment, second deflection information which indicates a correspondence relationship (refer to FIG. 10) between the ejection angle θ that corresponds to the deflection amount of the droplet and the phase difference Td is stored in advance in the storage section 56.

Figure 13:
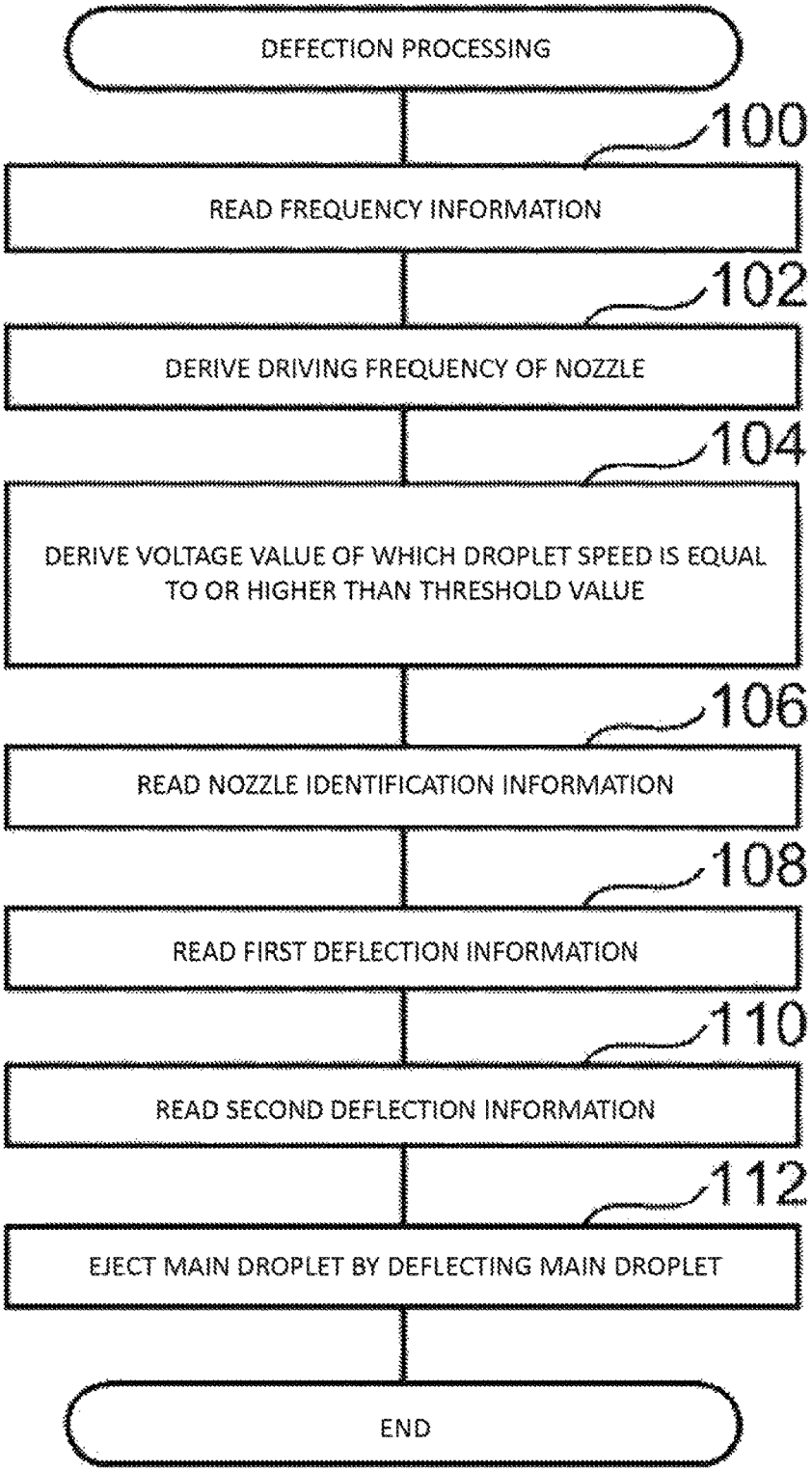
FIG. 13 is a flowchart illustrating a flow of processing of a deflection processing program according to the exemplary embodiment.

Next, an operation of the droplet ejection type recording device 10 according to the exemplary embodiment will be described with reference to FIG. 13. FIG. 13 is a flowchart illustrating a flow of processing of a deflection processing program executed by the CPU 50 in a case where the image forming instruction with respect to the paper sheet P is input. A main deflection processing program is installed in advance in the ROM 52. Here, in order to avoid complication, the description of processing of ejecting the droplet from the nozzle 32 other than the deflection nozzle 32 will be omitted.

In step 100 of FIG. 13, the CPU 50 retrieves the frequency information from the storage section 56. In the next step 102, the CPU 50 derives the driving frequency of the nozzle 32 by using image information which indicates the image which is the forming target, and the transport speed of the paper sheet P.

In the next step 104, the CPU 50 derives the voltage value in which the droplet speed is equal to or higher than the threshold value TH by using the frequency information retrieved in step 100 and the driving frequency derived in step 102.

In the next step 106, the CPU 50 retrieves the nozzle identification information from the storage section 56. In the next step 108, the CPU 50 retrieves the first deflection information from the storage section 56. In the next step 110, the CPU 50 retrieves the second deflection information from the storage section 56. In the next step 112, the CPU 50 deflects the main droplet from the deflection nozzle 32 adjacent to the defective nozzle indicated by the nozzle identification information retrieved in step 106, and performs a control of consecutively ejecting the main droplet and the sub-droplet.

Specifically, with respect to the deflection nozzle 32 adjacent to the piezoelectric element 44A side of the defective nozzle, as illustrated in FIG. 7 as an example, the CPU 50 applies the ejection voltage Vm which is the voltage value derived in step 104 in accordance with the ejection signal to the piezoelectric element 44A, and applies the deflection voltage Vc that follows the first deflection signal to the piezoelectric elements 44B. When applying the deflection voltage Vc, the CPU 50 applies the deflection voltage Vc which is the voltage value that corresponds to the ejection angle θ corresponding to the deflection amount of the main droplet to the piezoelectric elements 44B, in accordance with the first deflection information retrieved in step 108.

Meanwhile, regarding the deflection nozzle 32 adjacent to the piezoelectric elements 44B side of the defective nozzle, as illustrated in FIG. 9 as an example, the CPU 50 applies the ejection voltage Vm which is the voltage value derived in step 104 in accordance with the ejection signal to the piezoelectric element 44A, and applies the deflection voltage Vc that follows the second deflection signal to the piezoelectric elements 44B. When applying the deflection voltage Vc, the CPU 50 applies the deflection voltage Vc by the phase difference Td that corresponds to the ejection angle θ corresponding to the deflection amount of the main droplet to the piezoelectric elements 44B, in accordance with the second deflection information retrieved in step 110. When the processing of step 112 is finished, the main deflection processing is finished.

As described above, according to the exemplary embodiment, the ejecting direction of the main droplet ejected from the nozzle 32 adjacent to the defective nozzle is deflected toward the landing position of the main droplet of the defective nozzle along the intersecting direction, and the main droplet is ejected. Therefore, compared to a case where a large droplet is ejected from the nozzle adjacent to the defective nozzle, deterioration of granularity that follows suppressing processing of the deterioration of the image quality caused by the defective nozzle is suppressed.

In a case where the large droplet is ejected from the nozzle adjacent to the defective nozzle, in order to eject the droplet having a size greater than that determined in advance, for example, there is a case where the large droplet is ejected by consecutively ejecting the droplet by using the ejection signal of two cycles, and by allowing the droplet ejected later to follow the droplet which is previously ejected. Meanwhile, in the exemplary embodiment, without changing the size of the droplet, the ejecting direction of the droplet is changed. Therefore, according to the exemplary embodiment, compared to a case where the large droplet is ejected from the nozzle adjacent to the defective nozzle, the head 24 is driven at a high frequency, and as a result, the forming speed of the image increases.

In the exemplary embodiment, a case where the nozzle 32 which deflects the main droplet is fixed, is described, but the invention is not limited thereto. Regarding the plural nozzles 32 which are positioned within the distance determined in advance from the defective nozzle, an aspect in which the nozzle 32 which deflects the main droplet varies for each pixel of the transport direction, may be employed.

Figure 14:
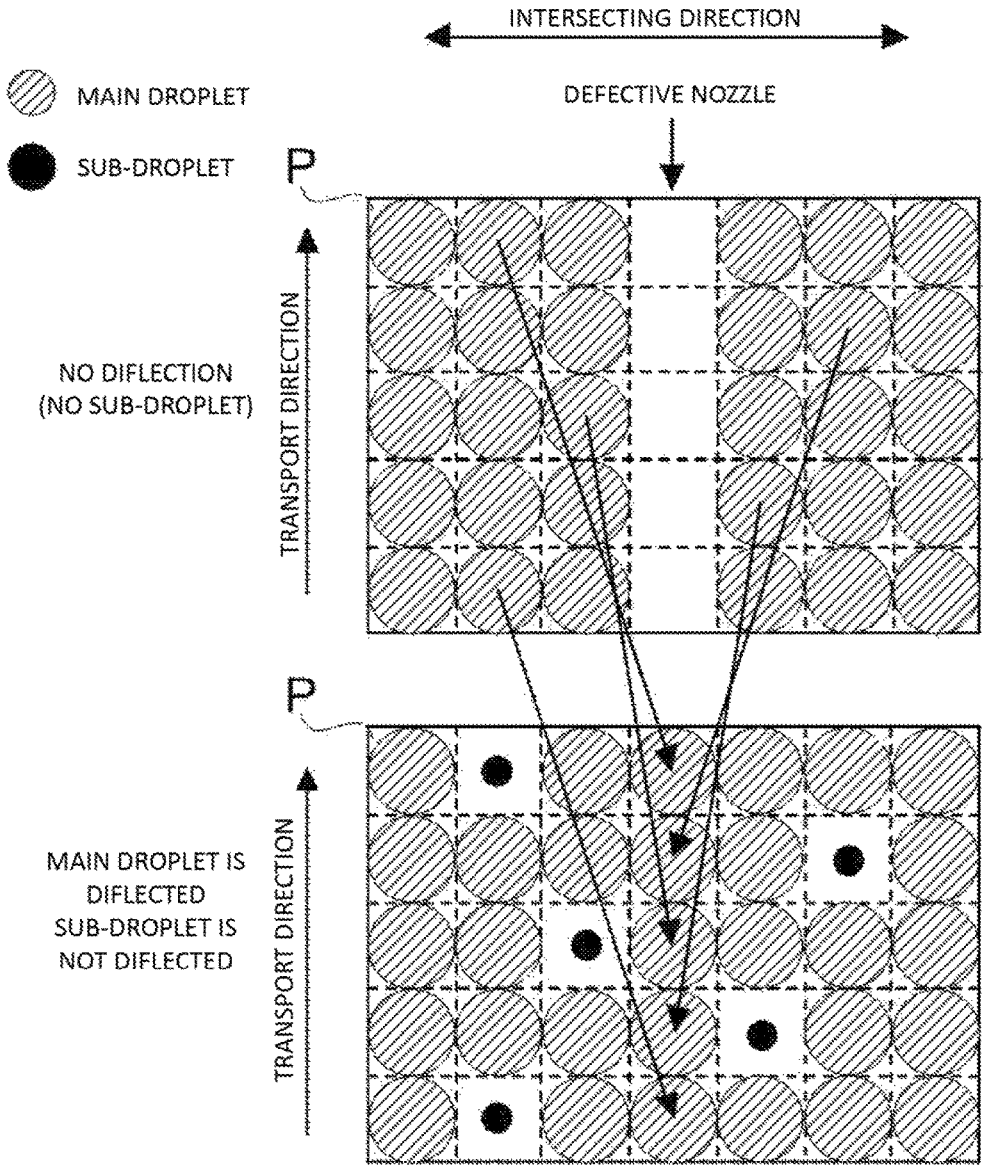
FIG. 14 is a plan view illustrating an example of the main droplet and the sub-droplet which land on the paper sheet in a case where the main droplet is not deflected and in a case where the main droplet is deflected according to a modification example.

In the aspect example, as illustrated in FIG. 14 as an example, a dot loss caused by the defective nozzle is not generated in the pixel which is continuous along the transport direction. The sub-droplet lands in the void generated due to the deflection of the main droplet. Therefore, the stripe generated due to the defective nozzle does not stand out, and deterioration of image quality is suppressed.

In the above-described exemplary embodiment, an aspect in which the main droplet ejected from all of the nozzles 32 which eject the main droplet other than the defective nozzle is deflected toward the landing position of the main droplet of the defective nozzle, and the main droplet and the sub-droplet are consecutively ejected, may be employed.

Figure 15:
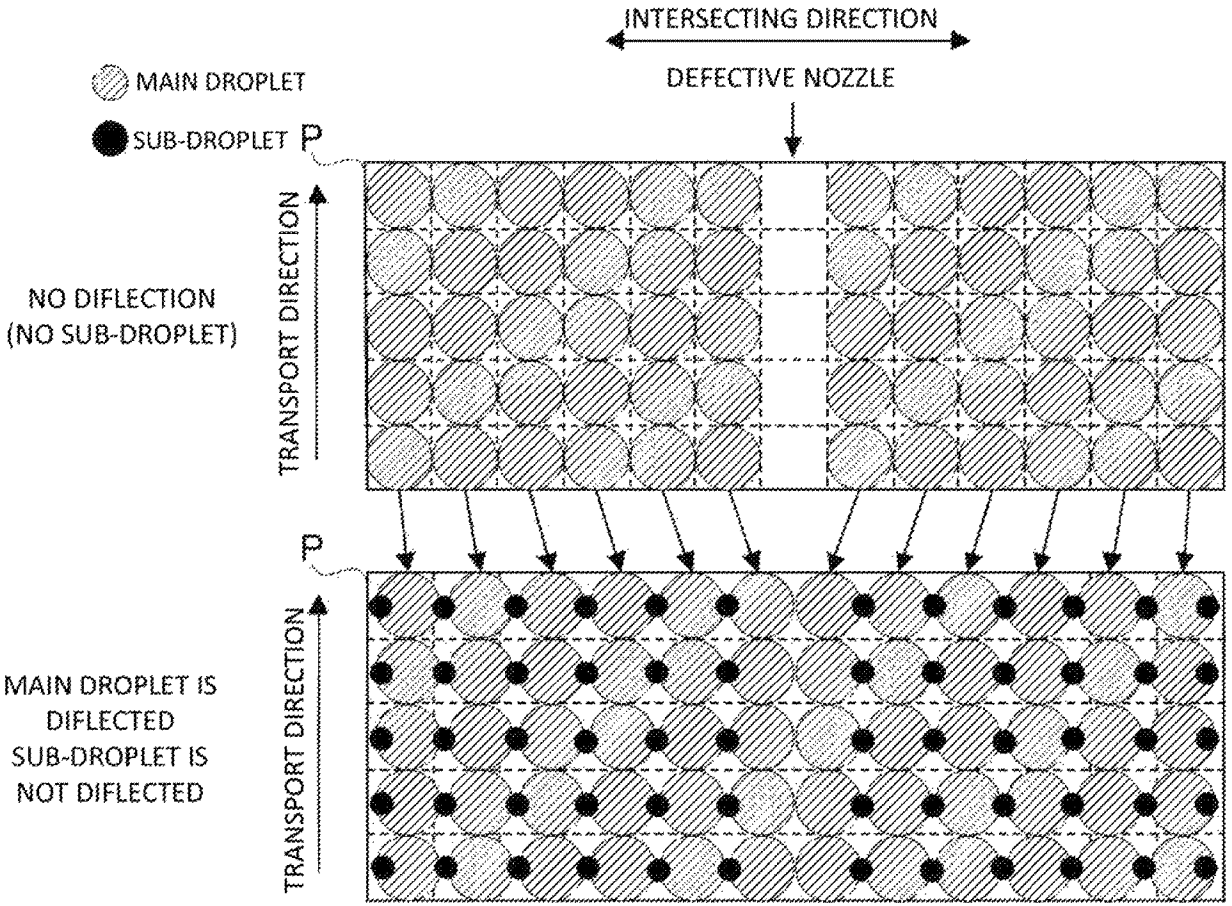
FIG. 15 is a plan view illustrating an example of the main droplet and the sub-droplet which land on the paper sheet in a case where the main droplet is not deflected and in a case where the main droplet is deflected according to the modification example.

In the aspect example, as illustrated in FIG. 15 as an example, the sub-droplet ejected from each of the nozzles 32 lands in the void generated due to the deflection and the ejection of the main droplet from each of the nozzles 32.

Therefore, the stripe generated due to the defective nozzle does not stand out, and deterioration of image quality is suppressed.

Figure 16:
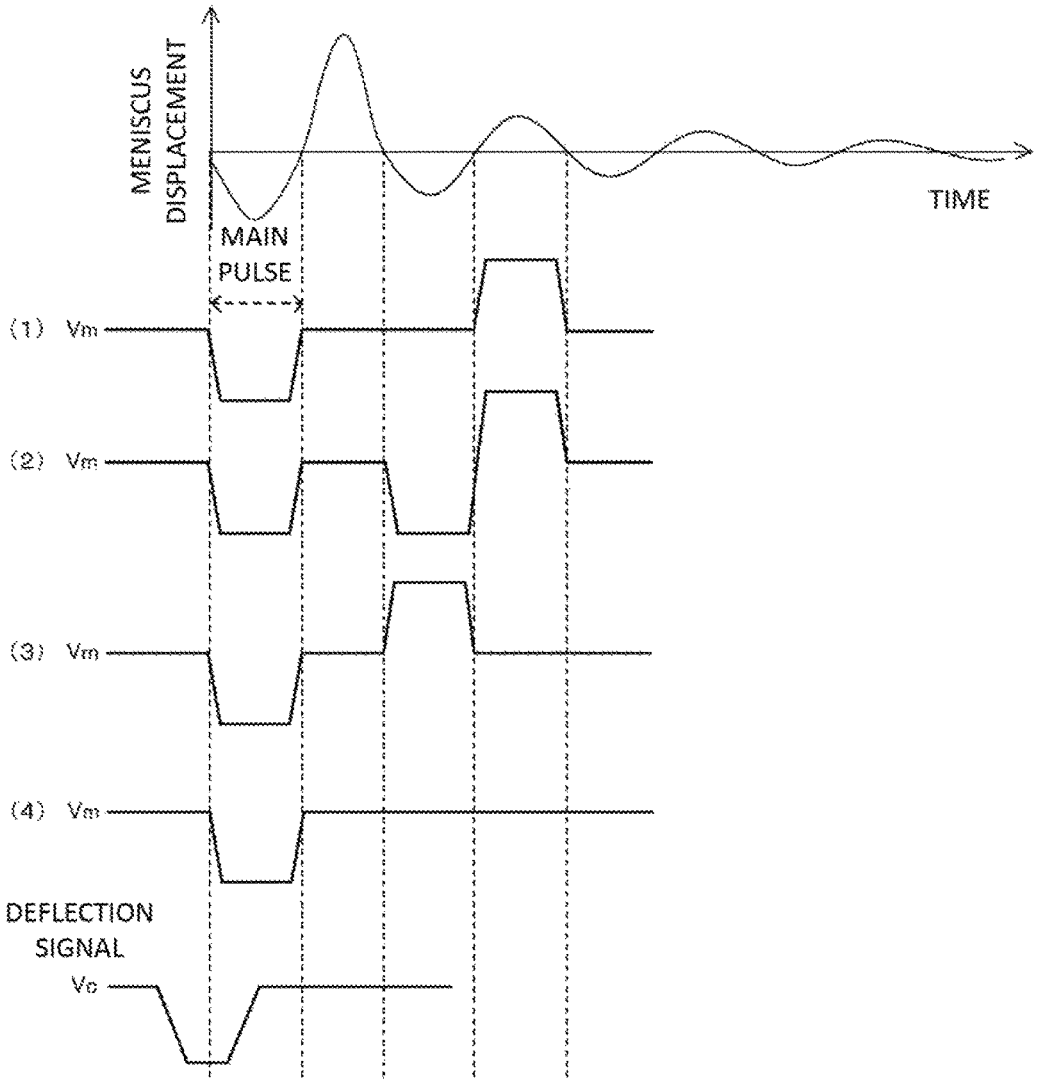
FIG. 16 is a waveform view illustrating an example of the waveform of the ejection signal in a case where the sub-droplet is ejected and in a case where the sub-droplet is not ejected according to the modification example.

In the exemplary embodiment, a case where the sub-droplet is ejected by controlling the voltage value of the ejection voltage Vm, is described, but the invention is not limited thereto. As illustrated in FIG. 16 as an example, an aspect in which the sub-droplet is ejected by changing the waveform of the ejection signal, may be employed. For example, as illustrated in FIG. 16(1), after inputting a main pulse for ejecting the main droplet, by inputting the pulse of which the voltage value increases in accordance with a period during which a meniscus displacement becomes plus, the ejection of the sub-droplet is suppressed. The meniscus displacement referred here means a position with respect to a nozzle surface 32A (a surface on which the nozzle 32 is formed, refer to FIG. 3) of the liquid surface of the nozzle 32. In the example of FIG. 16, the displacement in a case where the liquid surface of the nozzle 32 moves to the inner side (upper side of FIG. 3) of the nozzle 32 is illustrated as minus, and the displacement in a case where the liquid surface of the nozzle 32 moves to the outer side (lower side of FIG. 3) of the nozzle 32 is illustrated as plus.

For example, as illustrated in FIG. 16(2), after inputting the main pulse, by inputting the pulse of which the voltage value decreases in accordance with the period during which the meniscus displacement becomes minus, and by inputting the pulse of which the voltage value increases in accordance with the period during which the meniscus displacement becomes plus, the ejection of the sub-droplet is suppressed. Meanwhile, for example, as illustrated in FIG. 16(3), after inputting the main pulse, by inputting the pulse of which the voltage value increases in accordance with the period during which a meniscus displacement becomes minus, the ejection of the sub-droplet is promoted. For example, as illustrated in FIG. 16(4), there is also a case where the sub-droplet is ejected without suppressing the ejection of the sub-droplet as the pulse is not input after inputting the main pulse.

In the exemplary embodiment, an aspect in which the sub-droplet is not ejected in a case where the derived driving frequency of the nozzle 32 is lower than the threshold value determined in advance and the main droplet and the sub-droplet are consecutively ejected in a case where the driving frequency is equal to or higher than the threshold value, may be employed. An aspect in which a value determined in advance as an upper limit value of the driving frequency in a case where the image which is the forming target is a line image along the intersecting direction and characters, or the like is employed as the threshold value in this case, is illustrated as an example.

In the exemplary embodiment, a case where the deflection processing program is installed in the ROM 52 in advance is described, but the invention is not limited thereto. For example, as aspect in which the deflection processing program is provided to be accommodated in the recording medium, such as a compact disk read only memory (CD-ROM), or an aspect in which the deflection processing program is provided via a network, may be employed.

Furthermore, in the exemplary embodiment, a case where the deflection processing is realized by a software configuration by using a computer by executing the program is described, but the invention is not limited thereto. For example, an aspect in which the deflection processing is realized by using a hardware configuration, or by combining the hardware configuration and the software configuration to each other, may be employed.

The configuration (refer to FIGS. 1 to 3, and 11) of the droplet ejection type recording device 10 described in the above-described exemplary embodiment is an example, and it is needless to say that unnecessary parts may be eliminated or new pans may be added within a range that does not depart from the spirit of the invention.

A flow (refer to FIG. 13) of processing of the deflection processing program described in the above-described exemplary embodiment is also an example, and it is needless to say that unnecessary steps may be eliminated, new steps may be added, or a processing order may be switched within the range that does not depart from the spirit of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet ejecting apparatus comprising:

an ejecting section having a plurality of nozzles arranged along an intersecting direction with a transport direction of a recording medium, each of the nozzles being configured to consecutively eject a main droplet and a sub-droplet which is smaller than the main droplet, and each of the nozzles being configured to change a deflection amount in an ejecting direction of the main droplet along the intersecting direction; and a control section that performs, in a case where a defective nozzle exists in the nozzles, a control of deflecting the ejecting directions of the main droplets ejected from a nozzle positioned within a predetermined distance from the defective nozzle toward a landing position of a main droplet that should have ejected from the defective nozzle, and that perform a control of the nozzle positioned within the predetermined distance to consecutively eject the main droplet and the sub-droplet.

2. The droplet ejecting apparatus according to claim 1, wherein the nozzle positioned within the predetermined distance is a nozzle adjacent to the defective nozzle.

3. The droplet ejecting apparatus according to claim 1, wherein the control section makes a nozzle of which the ejecting direction of the main droplet is deflected different in each pixel along the transport direction in a case of performing the control.

4. The droplet ejecting apparatus according to claim 1, wherein the control section performs a control of deflecting the ejecting directions of the main droplets ejected from all nozzles except for the defective nozzle toward a landing position of a main droplet that should have ejected from the defective nozzle, and performs a control of the nozzles to consecutively eject the main droplet and the sub-droplet.

5. The droplet ejecting apparatus according to claim 1, wherein the control section calculates a driving frequency of the nozzle from image information and a transport speed of the recording medium, and controls an ejection voltage such that an ejecting speed of the main droplet at the driving frequency is equal to or higher than an ejecting speed of the sub-droplet.

6. An image forming apparatus comprising:

a transport section that transports a recording medium; and the droplet ejecting apparatus according to claim 1 that ejects a droplet to the recording medium transported by the transport section.

7. A non-transitory computer readable medium storing a program causing a computer to function as a control section of a droplet ejecting apparatus comprising:

an ejecting section having a plurality of nozzles arranged along an intersecting direction with a transport direction of a recording medium, each of the nozzles being configured to consecutively eject a main droplet and a sub-droplet which is smaller than the main droplet, and each of the nozzles being configured to change a deflection amount in an ejecting direction of the main droplet along the intersecting direction; and the control section that performs, in a case where a defective nozzle exists in the nozzles, a control of deflecting the ejecting directions of the main droplets ejected from a nozzle positioned within a predetermined distance from the defective nozzle toward a landing position of a main droplet that should have ejected from the defective nozzle, and that perform a control of the nozzle positioned within the predetermined distance to consecutively eject the main droplet and the sub-droplet.

* * * * *